US006275589B1

(12) United States Patent
Spille

(10) Patent No.: US 6,275,589 B1
(45) Date of Patent: Aug. 14, 2001

(54) METHOD AND APPARATUS FOR ERROR MASKING IN MULTI-CHANNEL AUDIO SIGNALS

(75) Inventor: Jens Spille, Hemmingen (DE)

(73) Assignee: Deutsche Thomson-Brandt GmbH, Villingen-Schwennigen (DE)

( * ) Notice: Subject to any disclaimer, the term of this patent is extended or adjusted under 35 U.S.C. 154(b) by 0 days.

(21) Appl. No.: 09/082,980

(22) Filed: May 21, 1998

(30) Foreign Application Priority Data

May 23, 1997 (DE) ..... 197 21 487

(51) Int. Cl.[7] ..... H04R 5/00

(52) U.S. Cl. ..... 381/22; 381/20; 381/23; 704/500; 704/200.1

(58) Field of Search ..... 381/22, 23, 20, 381/21; 704/500, 501, 503, 504, 200.1

(56) References Cited

U.S. PATENT DOCUMENTS 5,701,346 12/1997 Herre et al. ..... 381/18
5,920,833 * 6/1999 Dierke ..... 704/230
6,023,490 * 2/2000 Ten Kate ..... 375/240

FOREIGN PATENT DOCUMENTS

4409368A1 9/1995 (DE) ..... H04S/3/00
WO93/19541 9/1993 (WO) ..... H04H/5/00

* cited by examiner

*Primary Examiner*—Forester W. Isen
*Assistant Examiner*—Brian Pendleton
(74) *Attorney, Agent, or Firm*—J. S. Tripoli; D. T. Shoneman

(57) ABSTRACT

For audio coding, the MPEG-2 standard provides for a spatial representation by multi-channel reproduction. In order to ensure backwards compatibility with MPEG-1 signals, the signals of the multi-channel sound channels are matrixed. Before being matrixed, the audio signals generally have their levels reduced in order to prevent overdriving. In order to balance again the reduction at the encoder end, an option that is provided in the MPEG-2 standard is for a decoder to raise the output levels again. If, however, a transmission error then occurs in the multi-channel section, the decoder cannot carry out the reverse matrixing. In that case, only the MPEG-1-compatible signal component will be decoded. The auditory impression can therefore be disturbed in various ways during the changeover to MPEG-1 decoding. According to the invention, in the event of errors being detected in the supplementary signals, a portion of the multi-channel audio signals is cross-faded to the MPEG-1-compatible signal components and/or a further portion of the multi-channel audio signals is set to zero, in which case, at the decoder end, level raising of the MPEG-1-compatible signal components can be effected prior to the cross-fading of the multi-channel audio signals.

12 Claims, 2 Drawing Sheets

METHOD AND APPARATUS FOR ERROR MASKING IN MULTI-CHANNEL AUDIO SIGNALS

FIELD OF THE INVENTION

The invention relates to a method and an apparatus for error masking in multi-channel audio signals, in particular an MPEG-2 audio decoder.

BACKGROUND

For audio coding, the MPEG-2 standard provides for a spatial representation by multi-channel reproduction (multi-channel sound). The multi-channel sound in this case comprises three channels L, C, R (Left, Centre, Right), which are arranged spatially in front of the listener, and two channels LS, RS (Left Surround, Right Surround), which are arranged spatially behind the listener. In addition, a sixth channel for special effects is provided. In order to ensure backwards compatibility with MPEG-1 signals, the signals of the multi-channel sound channels are matrixed. The stereo signals L0 and R0 calculated in the process are then transmitted as MPEG-1-compatible stereo signal and the remaining three audio signals are transmitted as supplementary data.

Before being matrixed, the audio signals generally have their levels reduced in order to prevent overdriving. Thus, a value of L0=2.4 would result, for example, in the case of matrixing in accordance with L0=L+0.7C+0.7LS without attenuation, i.e. for L, C, LS=1. In order to balance again the reduction at the encoder end, an option that is provided in the MPEG-2 standard is for a decoder to raise the output levels again. If, however, a transmission error then occurs in the multi-channel section, the decoder cannot carry out the reverse matrixing. In that case, only the MPEG-1-compatible signal component, i.e L0 and R0, will be decoded. The auditory impression can therefore be disturbed in various ways during the changeover to MPEG-1 decoding. Thus, sudden changes in volume may occur, for example, since level raising is not carried out in MPEG-1 decoding.

SUMMARY OF THE INVENTION

The invention is based on the object of specifying a method for error masking in multi-channel audio signals. This object is achieved by means of the method specified in claim 1.

The invention is based on the further object of specifying an apparatus for carrying out the method according to the invention. This object is achieved by means of the apparatus specified in claim 7.

In principle, the method for the level matching of multi-channel audio signals, at the encoder end mono or stereo signals and supplementary signals being produced from the multi-channel audio signals by means of matrixing, and the mono or stereo signals being coded in accordance with a first coding standard and the supplementary signals being coded in accordance with a second coding standard, and at the decoder end the mono or stereo signals and supplementary signals being decoded and subjected to inverse matrixing, in order to obtain the multi-channel audio signals again, consists in the an fact that in the event of errors being detected in the supplementary signals, a portion of the multi-channel audio signals is cross-faded to the mono or stereo signals and/or a further portion of the multi-channel audio signals is set to zero.

In an advantageous manner, the multi-channel audio signals are in this case attenuated at the encoder end prior matrixing. Then, at the decoder end, level raising of the stereo signals is effected prior to the cross-fading of the multi-channel audio signals, the level raising at the decoder end then being reversed again after a period of time.

In this case, it may be particularly advantageous if the level raising is reversed in the event of errors being detected over a plurality of frames.

The first coding standard may be, in particular, the MPEG-1 standard and the second coding standard may be, in particular, the MPEG-2 standard.

A further advantageous development provides for the accoustics for the reproduction area to be calculated, the level raising being carried out in such a way that the deviation of the accoustics before and after the level raising is minimal.

Furthermore, in the event of multi-channel sound errors, a changeover and/or cross-fading to a pseudo-accoustics method may preferably be effected.

In principle, apparatus for the reproduction of multi-channel audio signals, having a first decoder for decoding mono or stereo signals and a second decoder for decoding supplementary signals, and an inverse matrixing device, to which the decoded signals are fed in order to produce the multi-channel audio signals, consists in the fact that a changeover switch is provided to which are fed the mono or stereo signals from the first decoder and an error signal from the second decoder and the multi-channel audio signals from the inverse matrixing device, a changeover from the multi-channel audio signals to the mono or stereo signals being effected when the error signal appears.

In this case, the changeover switch is preferably arranged upstream of the synthesis filter which is present at the decoder end.

It is furthermore advantageous if a unit for conflicting level raising is provided by which the level of the mono or stereo signal is raised in the event of an error.

It is particularly advantageous if, furthermore, a timer is provided which enables the level raising by the unit to be switched off after a period of time.

Furthermore, it may be advantageous to provide a unit by which the current accoustics are calculated, this value being fed to the unit for level raising.

BRIEF DESCRIPTION OF THE DRAWINGS

Exemplary embodiments of the invention are described with reference to FIGS. 1 and 2. The latter show block diagrams for two encoder-decoder arrangements according to the invention.

DETAILED DESCRIPTION

Figure 1:
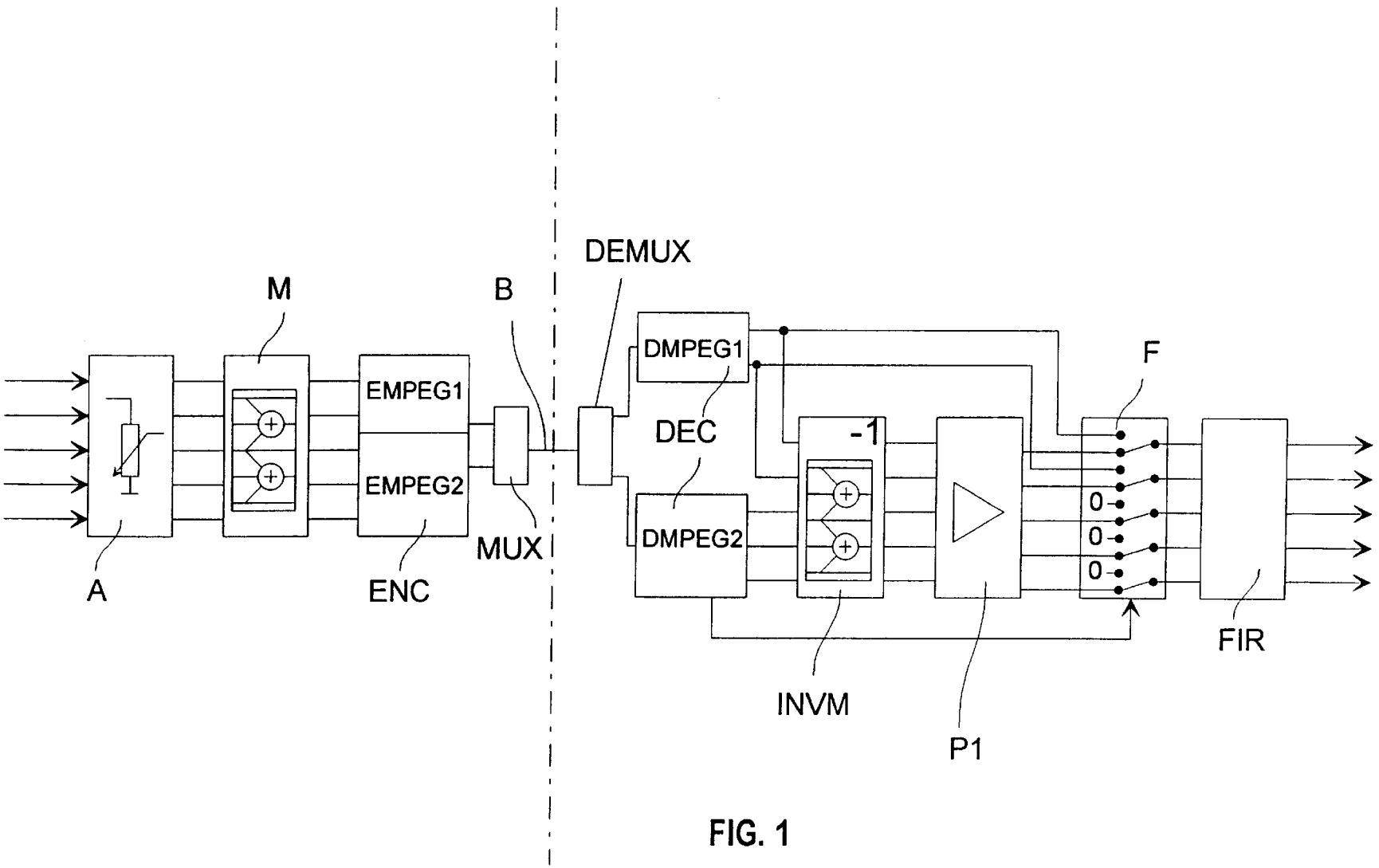

FIG. 1 illustrates an encoder-decoder arrangement according to the invention. The multi-channel audio signals LS, L, C, R, RS are first of all fed to an attenuator A. The level of the various audio channels is reduced by this attenuator in order to prevent overdriving by the subsequent matrixing M. Stereo signals L0 and R0 and also further multi-channel audio signals are calculated by this matrixing M. In the encoder ENC, the stereo signals L0 and R0 are then fed to an MPEG-1 encoder EMPEG1, as the remaining signals are fed to an MPEG-2 encoder EMPEG2. After MPEG coding and subsequent multiplexing by the multiplexer MUX, the audio signals are then transmitted as an elementary datastream B. After transmission, this bit stream is first of all fed to a demultiplexer DEMUX at the decoder end. The divided data streams are then fed to an MPEG-1 decoder DMPEG1 or MEPG-2 decoder DMPEG2 in the decoder DEC. The MPEG-decoded data are then fed to a unit INVM, in which the matrixing at the encoder end is reversed. The multi-channel audio signal obtained as a result of this is then fed to a unit P1 for level raising, in order to reverse the level reduction at the encoder end. Before these signals are then fed to the MPEG sythesis filter SYNF,(FIR) according to the invention the signals first pass through an error changeover switch F. This error changeover switch is activated by an error message fed to it by the MPEG-2 decoder DMPEG2. The error message is in this case output if an error-free frame, which comprises 1152 samples in the case of MPEG, is followed by an errored frame. In this case, the signals fed to the filter FIR are switched over by the error changeover switch F in the following way: the channels Left and Right are changed over from the MPEG-2 signals L and R to the MPEG-1 signals L0 and R0. For this purpose, these signals are fed by the MPEG-1 decoder not only to the inverse matrix INVM but also to the error changeover switch F. Furthermore, the channels Centre, Left Surround and Right Surround are changed over to the value 0 in the error changeover switch F. By virtue of the inventive arrangement of the error changeover switch upstream of the synthesis filter SYNF, the changeover of the various channels in this case leads to cross-fading of the signals, with the result that abrupt changes in volume do not occur.

Figure 2:
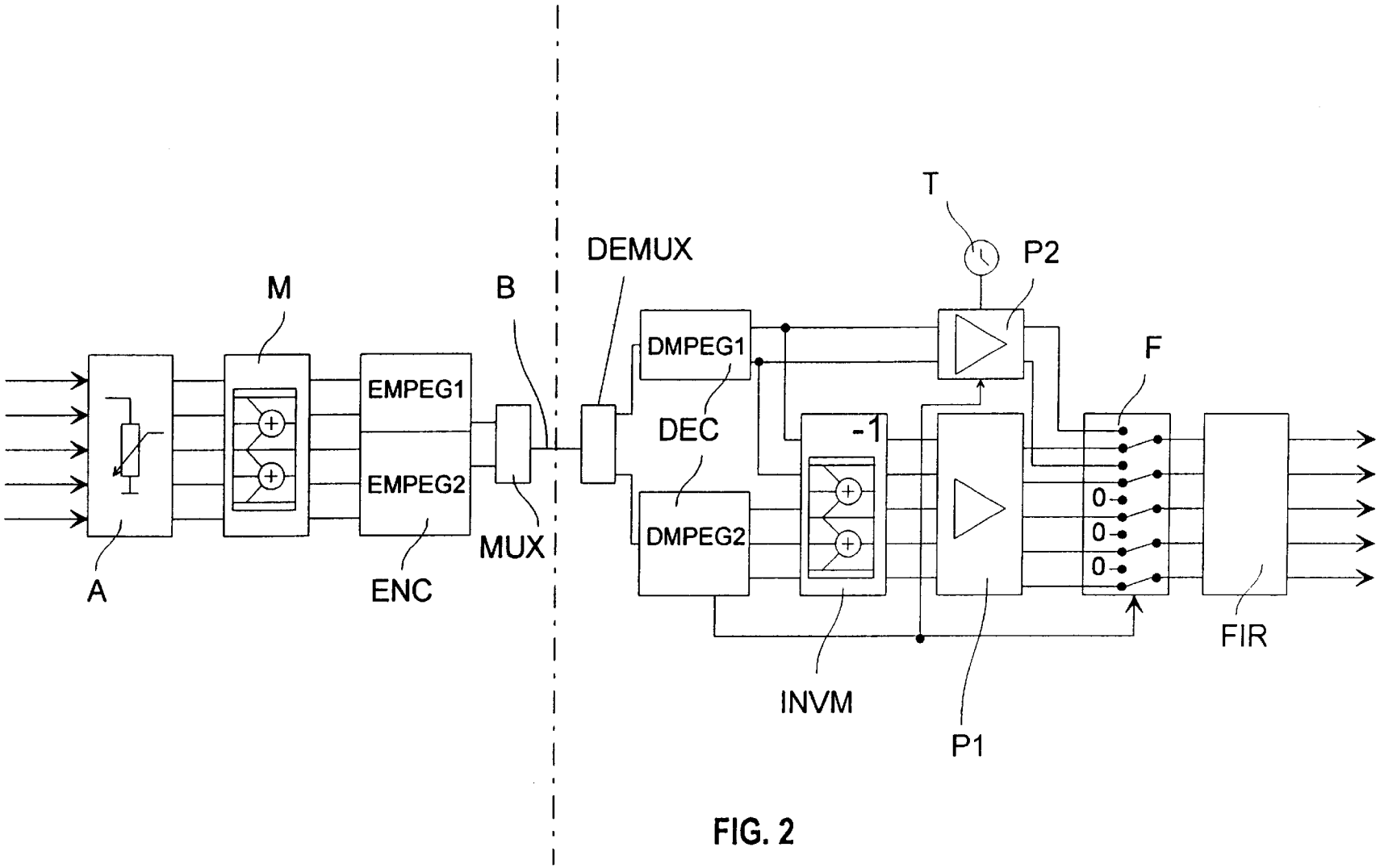

FIG. 2 illustrates a further encoder-decoder arrangement according to the invention in which level raising of the MPEG-1 datastream is additionally effected. Processing at the encoder and decoder ends is in this case effected in the manner described in FIG. 1, but another unit for level raising P2 and, optionally, a timer T for controlling the level raising are additionally provided at the decoder end. In addition to the MPEG-1 signals, an error signal is fed from the MPEG-2 decoder to the unit for level raising if an error occurs in the multi-channel audio signals. In this case, as already described with reference to FIG. 1, a switch is made back to MPEG-1 decoding in the error changeover switch F. In addition, however, level raising of these signals is also effected by the level raising unit P2, in order to avoid or at least reduce sudden changes in volume. Since this level raising can occasionally lead to overdriving, it may be slowly reversed again, under the control of the timer T.

It is likewise possible for timer-controlled level raising and restoring to be carried out in the following case: an error message does not necessarily have to be caused by a transmission error. Instead of this, such an error signal in the multi-channel section is also used as a discriminating feature of MPEG-1 signals and MPEG-2 signals. Thus, if a multi-channel error occurs over a plurality of frames, then it may be assumed that an MPEG-1 signal is being transmitted instead of an MPEG-2 signal. In this case, too, the level raising by the unit P2 can be switched off again after a number of frames slowly or else abruptly, for example during signal intervals.

The invention can be utilized for the reproduction of digitally coded audio signals in which multi-channel sound transmission is effected or provided. This may involve MPEG-2 coding, for example, but equally Dolby AC3 coding as well, for which a stereo/mono signal is sent in a simulcast manner. The reproduction can in this case be effected by a wide variety of audio reproduction devices, such as e.g. DVD players, computers with sound cards, radio or television receivers.

What is claimed is:

1. Method for the level matching of multi-channel audio a signals, at the encoder end, mono or stereo signals and supplementary signals being produced from the multichannel audio signals by means of matrixing, and the mono or stereo signals being coded in accordance with a first coding standard and the supplementary signals or all of the channels being coded in accordance with a second coding standard, the method comprising the steps of:

decoding the mono or stereo signals and the supplementary signals to generate decoded mono or stereo signals and decoded supplementary signals;

inverse matrixing said decoded signals to generate the multi-channel audio signals;

monitoring said supplementary signals to generate an error signal in response to the detection of errors; and cross-fading a portion of the multi-channel audio signals, in response to said error signal, to said decoded mono or stereo signals and setting a further portion of the multi-channel audio signals to zero.

2. Method according to claim 1, further comprising the steps of attenuating the multi-channel audio signals at the encoder end prior to matrixing; raising the level of the stereo signals at the decoder end prior to cross-fading of the multi-channel audio signals, and adjusting the level raising at the decoder end again after a period of time.

3. Method according to claim 2, wherein the step of adjusting the level raising occurs in response to errors being detected over a plurality of frames.

4. Method according to claim 3, wherein first coding standard is the MPEG-1 standard and the second coding standard is the MPEG-2 standard.

5. Method according to claim 2, wherein the step of adjusting the level raising at the decoder end comprises switching off the level raising of the stereo signals at the decoder end.

6. Method for error masking of matrixed multi-channel audio signals comprising:

decoding a first audio signal to generate a first decoded audio signal;

decoding a supplementary audio signal to generate a second decoded audio signal;

generating an error signal in response to detecting an error in said supplementary audio signal;

inverse matrixing said first and second audio signals to generate the multi-channel audio signals;

raising the level of said multi-channel audio signals;

raising the level of said first decoded audio signal; and, switching between said level-raised multi-channel audio signals and said level raised first decoded signal in response to said error signal.

7. The method according to claim 6 further comprising the step of setting a portion of the multi-channel audio signals, corresponding to said second decoded audio signal, to zero.

8. Method according to claim 6 wherein the step of level raising is switched on and off in response to said error signal being detected over a plurality of frames.

9. Method according to claim 8 wherein said first audio signal is encoded by the MPEG-1 standard and said supplementary audio signal is encoded by the MPEG-2 standard.

10. Apparatus for the reproduction of multi-channel audio signals comprising:

first means for decoding a first audio signal and for generating a first decoded audio signal;

second means for decoding a supplementary audio signal and for generating a second decoded audio signal;

means for generating an error signal in response to detecting an error in said supplementary audio signal;

means, coupled to said first and second decoding means, for inverse matrixing said first and second decoded audio signals to generate the multi-channel audio signals;

first means, coupled to said first decoding means, for level raising said first decoded audio signal;

second means, coupled to said inverse matrixing means, for level raising said multi-channel audio signals; and, means, coupled to said first level raising means and said second level raising means, for switching between the level raised multi-channel audio signals and said level raised first decoded audio signal in response to said error signal.

11. Apparatus according to claim 10 further comprising a synthesis filter coupled to said switching means.

12. Apparatus according to claim 10 further comprising timing means, coupled to said first level raising means, for causing said level raising means to attenuate said level raised first decoded audio signal in response to said error signal.

* * * * *